United States Patent [19]

Fiddler et al.

[11] Patent Number: 4,662,270

[45] Date of Patent: May 5, 1987

[54] DOOR JAMB POST AND VALVED VENT PASSAGE WITH HEATER

[75] Inventors: R. Charles Fiddler; Nathan L. Coleman, both of Parson, Tenn.

[73] Assignee: Kolpack Industries Inc., Parson, Tenn.

[21] Appl. No.: 771,358

[22] Filed: Aug. 30, 1985

[51] Int. Cl.[4] ..... F25D 17/04

[52] U.S. Cl. ..... 98/82; 62/409; 62/410; 98/119

[58] Field of Search ..... 62/408, 409, 410; 98/87, 118, 119; 137/341, 855

[56] References Cited

U.S. PATENT DOCUMENTS

| | | | |
|---|---|---|---|
| 3,115,155 | 12/1963 | Clark | 137/855 X |
| 3,191,618 | 6/1965 | McKim | 137/855 |
| 3,680,329 | 8/1972 | Burtis | 62/275 |
| 3,813,896 | 6/1974 | Lebahn | 62/409 |
| 3,826,106 | 7/1974 | O'Hanlon et al. | 62/275 |
| 3,916,643 | 11/1975 | Brown | 62/410 |
| 3,952,542 | 4/1976 | Berkowitz | 62/409 |
| 4,116,213 | 9/1978 | Kamezaki | 137/360 |
| 4,180,093 | 12/1979 | Kamezaki | 137/360 |
| 4,235,162 | 11/1980 | Schmidt | 98/19 |
| 4,257,445 | 3/1981 | Cook et al. | 137/341 |
| 4,257,458 | 3/1981 | Kondo et al. | 137/855 |
| 4,471,812 | 9/1984 | Bertsch | 137/855 |

*Primary Examiner*—Harold Joyce

*Attorney, Agent, or Firm*—Irvin A. Lavine

[57] ABSTRACT

A door jamb for a cold storage room is provided with a tranverse passage for passage of air from the exterior into the interior of the cold storage room. A thin metal flap valve, specifically of stainless steel, is placed at the exterior end of the passage, seated on a flat plate. An electric heater in the passage prevents the valve from being immobilized in the closed position due to frozen condensation.

20 Claims, 4 Drawing Figures

FIG-1
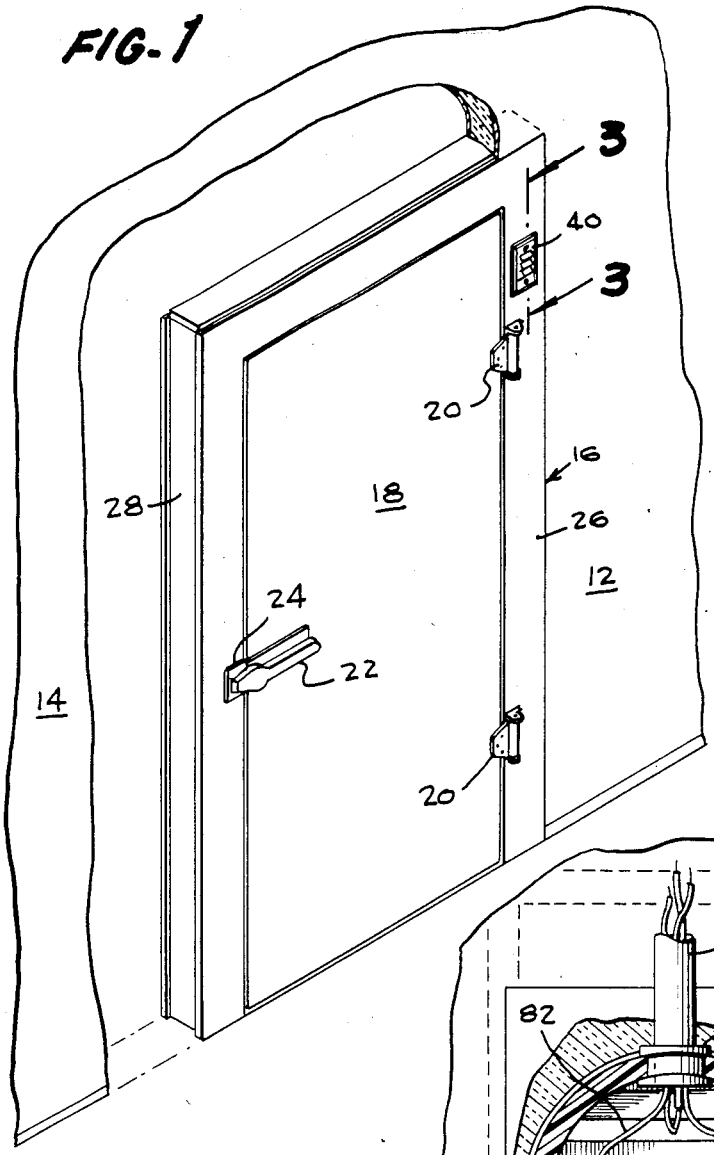
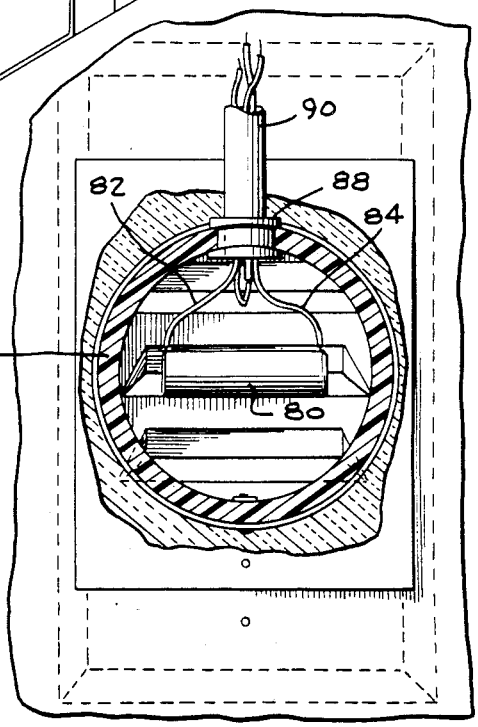
FIG-4

DOOR JAMB POST AND VALVED VENT PASSAGE WITH HEATER

TECHNICAL FIELD

The present invention relates to a cold storage room construction, including a hollow door post with a passage transversely therethrough, and a valve for closing the passage.

BACKGROUND ART

Cold storage rooms are in wide spread use for storing, at very low temperatures, various food products. Such cold storage rooms are used in great numbers in the warehousing of frozen foods, and in the storing of frozen foods at grocery stores. Cold storage rooms are well insulated, so that the ceilings, walls and flooring are insulated against the entry of heat energy. Refrigeration apparatus is provided in order to cool the air and the merchandise within the cold storage room.

The cold storage rooms are provided with doors so that personnel and material may enter and leave. It has long been recognized that when the door is opened, warm air is admitted into the cold storage room. This warm air is cooled, and condenses, and would create a lower pressure within the cold storage room than atmospheric. Since the pressure differential tends to cause the cold storage room to collapse inwardly, due to the higher external pressure, such cold storage rooms have been provided with a vent passage, with a valve for admitting air through the passage and into the cold storage room from the exterior, with closing of the valve after the interior pressure has become substantially equal to the outside, atmospheric pressure.

In the construction of cold storage rooms, panels having insulating between the walls are used. As above-noted, a door is provided in an entryway, to provide for ingress and egress. It is now the preferred construction of such cold storage rooms to provide a prefabricated door jamb, including a threshold, and a generally inverted U-shaped structure including a pair of hollow posts, and a connecting hollow transom. The door is mounted to the door jamb structure by hinges, and electrical conduits are enabled to be placed within the door jamb assembly, for such purposes as mounting a light on the door jamb assembly. After construction, foam-in-place pastic is introduced into the interior of the pre-fabricated door jamb.

There have been provided the above-noted pressure relief valves in vent passages in the panels of the cold storage room. The vent passages which have been provided in such installations have been of relatively large construction, and due to the fact that it has been necessary to provide a heater in these passages, in addition to the control valve, it has been necessary to modify the panels to receive electrical conductors to provide energy to the heaters. This has required on-site modification of the panels, at substantial expense in both labor and materials.

Prior art constructions, as disclosed in various United States Patents, have proven deficient. For example, Labahn U.S. Pat. No. 3,813,896 provides an air vent tube through a wall of a walk-in frezer unit having a valve housing outwardly of the exterior wall at the outer end of the tube, containing a pair of valves, the valve elements being ping-pong balls. The positioning of the valve housing is undesirable, and the construction is somewhat expensive, requiring modification of a wall of the walk-in frezer.

Berkowitz U.S. Pat. No. 3,952,542 discloses a large diameter vent passage with dual plate valves in the wall or door of a cold room. A separate electrical junction box is provided, as well as an external conduit for the passage of electrical junction to the connector box.

Cook et al. U.S. Pat. No. 4,257,445 provides a valve construction in the wall of a walk-in refrigerator, and including embodiments with valves with springs, solenoid operated valves, etc. The construction includes, in one embodiment, a heater for a guide rod for a valve element.

Burtis U.S. Pat. No. 3,680,329 discloses a plate valve, pivoted to a support, and carried within a ventilator passage extending through a wall of a refrigerator. A heater is provided in this construction. The assembly is very wide, in comparison to a door of the cold room.

Schmidt U.S. Pat. No. 4,235,162 provides a mounting arrangement for pressure relief valves provided in the cooling rig of a transportation vehicle, the construction including plates providing a labyrynth path.

Kamezaki U.S. Pat. No. 4,116,213 and Kakmezaki U.S. Pat. No. 4,180,093 each discloses a cold storage chamber with a door and air pressure control apparatus in a wall, including pivoted plate valves on the interior and exterior.

In the installation where a vent passage has been provided, it has uniformly been provided in a wall of a cold room or other enclosure, and there has typically been provided a relatively large passage and large valves, with special additional construction for the provision of electrical conductors to supply energy to a heater.

DISCLOSURE OF INVENTION

A door jamb forming a part of a cold storage room has a hollow post with interior and exterior plates. A transverse passage provided by a tube of non-conductive plastic material extends transversely through the hollow post, and is secured to the interior and exterior plates, perferably by flanges having collars which engage the tube. A simple, two-part valve is provided at the exterior end of the tube, including a plate with an opening in alingment with the passage in the tube, providing a valve seat, and a valve element; the valve element is a flexible stainless steel sheet, of approximately 0.002 inches thickness, and attached at its top, extending downwardly across the opening in the valve seat plate, and seating thereagainst by action of the resiliency of the stainless steel valve element and the action of gravity on the unattached lower portion thereof. A heater is provided in the tube, having conductors extending to it, and into a conduit connected to the tube, the conductors extending through the conduit, for connection to appropriate current supply main lines.

Among the advantages of the present invention are the provision of a door jamb with a vent passage, valve and heater installed therein, the avoidance of modification of cold storage room doors or panels, such as by the provision of passages and conduits and conductors. Other advantages of the present invention are to provide a pre-wired and pre-assembled door jamb, vent passage, valve and heater, to provide a valve of extremely simple but dependable construction, to provide such a valve in a cold storage room structure which will readly open upon a lower-than-atmospheric pressure within the cold storage room, while providing a good seal when the pressure within the cold storage room is at least equal to atmospheric pressure. The herein disclosed valve construction is inexpensive, and the construction including the door jamb with its door jamb post and assembled vent passage, valve and heater being inexpensive to produce and to install. Another advantage to the present invention is that a combination door jamb post and heated valve and passage in accordance with the present invention provides for lower installation costs. The transverse passage, heater and valve assembly are able to be placed in a conventional door jamb post having an available width of only about four inches.

BRIEF DESCRIPTION OF THE DRAWINGS

FIG. 1 is a perspective view of a part of a cold room, including a door jamb in accordance with the present invention.

FIG. 4 a cross-sectional view taken on the line 4—4 of FIG. 3.

BEST MODE OF CARRYING OUT THE INVENTION

Figure 3:
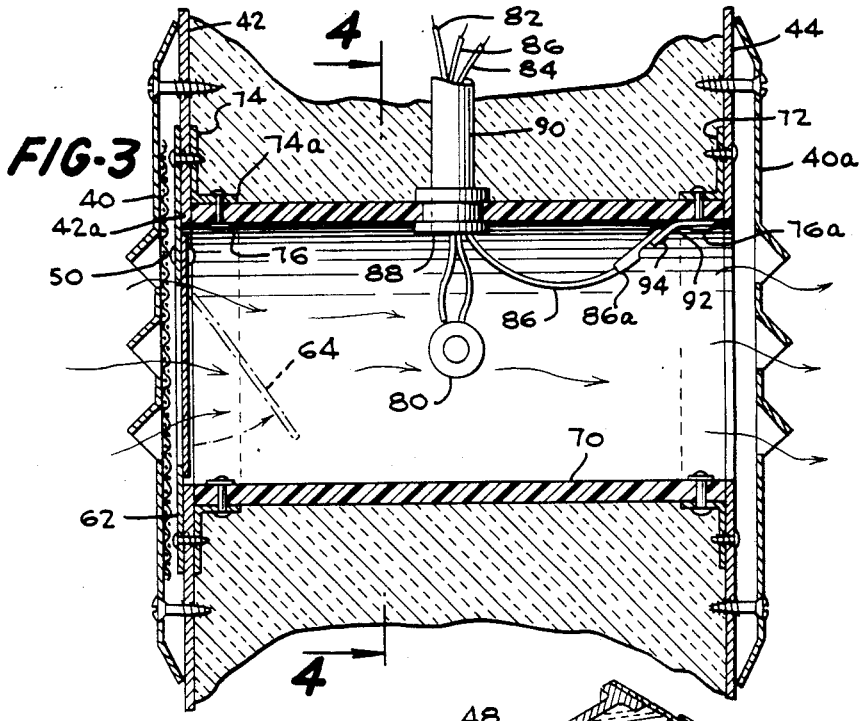
FIG. 3 is a cross-sectional view taken on the line 3—3 of FIG. 2 with the parts in assembled relationship.

Referring now to the drawings, wherein like or corresponding reference numerals are used to designate like or corresponding parts throughout the several views, there is shown in FIG. 1 a part of a cold storage room generally designated 10, and including a wall panel 12, and a wall panel 14, the later being broken away. Assembled to the wall panels 12 and 14 is a door jamb generally designated 16. A door 18 is attached to the door jamb 16 by conventional hinges 20, and door 18 may be secured in the closed position by a conventional handle 22 and striker 24. The door jamb 16 includes a pair of spaced, parallel, generally vertically extending posts 26 and 28, joined across their top by a hollow transom 30. A plate 40 is shown mounted on the hollow door post 26 of the hollow door jamb 16.

Figure 2:
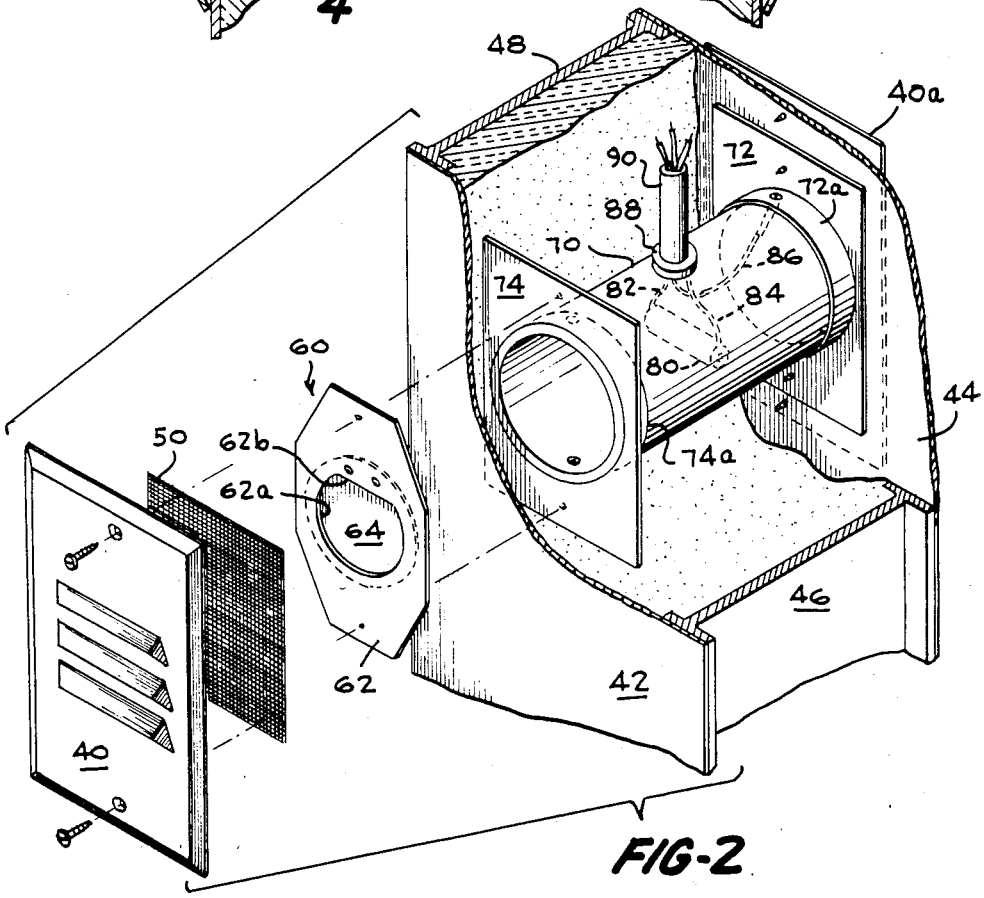
FIG. 2 is an exploded perspective view, with parts removed, showing the hollow door jamb construction with vent passage, valve and heater in accordance with the present invention.

In FIG. 2, there is shown the hollow post 26, including an exterior plate 42, an interior plate 44, joined in spaced, parallel relationship by longitudinal structural elements 46 and 48, which may take one or another known shape. An opening **42*a* is provided in the exterior plate 42, and an opening 44*a* (see FIG. 3) in the interior plate 44**.

The cover plate 40 is shown, and is of conventional construction, provided with louvered slits for the passage of air. Inwardly of the cover plate 40 is an insect screen 50.

A valve 60 is provided, comprising a valve seat 62 in the form of a plate having an opening **62*a* therein, opening 62*a* being in the form of a modified circle, with an upper horzontal sector line 62*b*. A generally disc-shaped valve element 64 is secured by rivets to the portion of the valve seat plate 62 which is just above the sector line 62*b*. The valve element 64 is a resilient stainless steel sheet, of 0.002 inch thickness, made of conventional shim stock. As shown, the upper-most portion of the valve element plate 64 is that which is secured to the valve seat plate 62, the remaining lower protion of the valve element plate 64** extending downwardly therefrom.

A passage through the hollow post 26 is provided by a transversely extending tube 70, which is of non-conductive plastic material. In practice, the tube 70 has a diameter of approximately 2 inches, being standard PVC pipe. At its interior end, adjacent the interior plate 44 of hollow post 46, there is a flange 72, which may be of rectangular shape, and having an integral collar **72*a* which is telescoped onto the exterior of the PVC tube 70. At the outer or exterior end of tube 70 there is a flange 74 which has a collar 74*a* extending from it, and is also in telescopic relationship with the outer surface of tube 70**.

A conventional resistor 80 functions as a heater, the resistor 80 being a 4,000 ohm, 25 watt resistor. Resister 80 has connected to it conductors 82 and 84, which support it transversely in the passage provided by tube 70, and intermediate the ends thereof. A grounding conductor 86 is also shown within tube 70. The conductors 82, 84 and 86 extend upwardly through an appropriate fitting 88, and through a conduit 90. The conduit 90, having the conductors 82, 84 and 86 therein, extends through the hollow post 26, to an appropriate junction box, where the conductors may be appropriately connected to power supply mains in conventional fashion.

Referring now to FIG. 3, the conventional louvered air inlet plate 40 is shown, secured to exterior plate 42 of hollow post 26 by screws, such as self-tapping metal screws. Insect screen 50 is shown inwardly of the plate 40, pressed against the valve seat plate 62, which is secured by a screw to the flange 74. The opening **62*a* is in alignment with the passage in the tube 70, with only the part of valve seat plate 62 above sector line 62*b* covering the passage. Flage 74 engages the inner surface of exterior plate 42 of hollow post 26, held in place by screws. The collar 74*a* of flange 74 has a rivet 76 extending through it and tube 70, to thereby secure in assembled relationship the exterior plate 42, flange 74 and tube 70. The stainless steel shim stock valve element 64 is shown in open position, thereby admitting air from the exterior into the cold storeage room 10**.

The conduit 90 extends into the tube 70, through the fitting 88 located in an opening **70*a* in tube 70. The conductors 82, 84 and 86 are seen extending through the conduit 90, the conductors 82 and 84 being connected to and supporting the resistor-heater 80, the grounding conductor 86 having a terminal fitting 86*a* thereon. A second rivet 76*a* extends through tube 70 and the collar 72*a* of flange 72. A conductive tab 92 is secured to the interior of the tube 70 by rivet 76*a*, and a screw 94 secures the terminal 86*a* to the tab 92, thereby providing a grounding connection to the flange 72, etc. Flange 72 is secured by screws to the interior plate 44 of hollow post 26, and a conventional louvered cover plate 40*a* is secured by screws to the interior plate 44**, being in the interior of the cold storage room.

FIG. 4 shows the heater 80 transversely in the tube 70, supported by conductors 82 and 84.

As will be understood, the entire assembly as shown in FIG. 3 is constructed during the construction of the hollow door post 26, including the provision of the tube 70 therewithin, and the mounting of the heater 80, the conduit 90 and the conductors 82, 84 and 86. The assemblage is filled with plastic foam (not shown) and the insect screen 50 and the cover plates 40 and **40*a***. Consequently, at the site where the cold storage room is constructed, there only need be provided a connection to the noted conductors, and any other conductors which may be within the door jamb assembly, in conventional manner.

The valve element plate 64 will move to the full line position shown in FIG. 3, thereby admitting air into the interior of the cold storage room 10, due to the flexibility of the stainless steel of which it is constructed. Since the upper part of the valve element plate 64 is attached, the depending part will, by gravity and by the resiliency of the material, move to the closed position, providing a good sealing contact with the valve seat plate 62, when the pressure within the cold storage room is substantially equal to the atmospheric pressure on the exterior thereof. The heater 80 is of durable construction, and provides sufficient heat to the valve 60 to prevent malfuction due to frozen condensation.

The valve, conduit and heater are relatively small, so that they can be installed in and on a conventional door jamb post having an available space of only about four inches in width.

The claims and the specification describe the invention herein presented and the terms that are employed in the claims draw their meaning from the use of such terms in the specification. Some terms employed in the prior art may be broader in meaning than specifically employed herein. Whenever there is a question between the broader definition of such terms as used in the prior art and the more specific use of the term herein, the more specific meaning is meant.

It will be obvious to those skilled in the art that various changes may be made in the herein disclosed apparatus. However, the invention is not limited to what is set forth in the specification or described in the drawing, but only as defined in the claims appended hereto.

We claim:

1. In a door jamb for a cold storage room comprising wall panels, a door jamb and a door supported by the door jamb, (a) said door jamb comprising a hollow post having a longitudinally extending interior plate and a longitudinally extending exterior plate in spaced apart, generally parallel relationship and transverse longitudinal elements jointed to said plates, (b) means defining a passage through said post transversely of said plates and between said longitudinal elements, (c) a valve for said passage comprising a valve seat and a valve element, said valve seat being a plate extending transversely of said passage and having an opening therethrough in alignment with said passage, said valve element being a thin sheet of resilient material extending across said opening in said valve seat in the closed position of said valve, and means for attaching said valve element to said valve seat for movement of said valve to an open position in which parts of said valve element are spaced from said valve seat and extend into said passage, and (d) means in said passage for heating said valve.

2. The aparatus of claim 1, said means defining said passage comprising a tube of plastic.

3. The apparatus of claim 2, said means defining said passage having a transverse mounting flange at each end thereof, and means for attaching each said mounting flange to said tube.

4. The apparatus of claim 3, said last mentioned means comprising a collar extending from each said mounting flange and telescoped over said tube.

5. The apparatus of claim 1, said attaching means located at an upper part of said valve element.

6. The apparatus of claim 5, said valve element being a thin sheet of stainless steel.

7. The apparatus of claim 1, said valve seat comprising a portion covering an upper part of the passage in said passage defining means, said attaching means attaching said valve element to said portion.

8. The apparatus of claim 7, said valve element being a thin sheet of stainless steel.

9. The apparatus of claim 8, said stainless steel valve element having a thickness of approximately 0.002".

10. The apparatus of claim 1, said valve element being a thin sheet of stainless steel.

11. The apparatus of claim 10, said stainless steel valve element having a thickness of approximately 0.002".

12. The apparatus of claim 1, said heating means comprising an electric heat source in said passage defining means.

13. The apparatus of claim 12, said heat source being a resistor.

14. The apparatus of claim 13, said heat source located at approximately the middle of said passage defining means.

15. In combination, (a) a hollow post of a door jamb for a cold storage room, the post having spaced, substantially parallel longitudinally extending interior and exterior plates, spaced transverse longitudinal elements joined to said plates and a pair of aligned openings in said plates, (b) a tube extending transversely of said plates between said longitudinal elements and having a passage therethrough in alignment with said openings, (c) means for securing said tube to said plates, (d) a valve for said tube comprising a valve seat and a valve element, (e) means in said tube for heating said valve element, and (f) conductors connectd to said heating means and extending from said tube in the hollow post between said plates and said elements, said post adapted to have plastic foam in the hollow thereof.

16. The combination of claim 15, said tube being of electrically non-conducting material.

17. The combination of claim 15, said valve seat comprising a plate with an opening, means for securing said valve seat plate to said tube with the opening aligned with said passage, said valve element being resilient metal sheet, means for supporting said sheet in adjacent inward relationship to the valve seat and engaging said sheet at an upper protion thereof, the valve element depending from said supporting means.

18. The combination of claim 17, said valve element being a thin sheet of resilient stainless steel.

19. The combination of claim 15, said valve element being a thin sheet of resilient stainless steel.

20. In combination with a cold storage room, (a) a door jamb comprising a post, (b) said post defining a longitudinally extending hollow therein and adapted to be substantially filled with plastic foam, (c) said post having therein means defining a pair of aligned openings for passage of air through said post from the exterior to the interior of said cold storage room, (d) a tube having a passage therethrough, (e) means for mounting said tube in said post and in communication with said openings therein, (f) a valve for said tube comprising a valve seat and a valve element, (g) means in said tube for heating said valve element, and (h) conductors connected to said heating means and extending at least partially through the hollow in said post.

* * * * *